US008141872B2

(12) United States Patent
Maeda et al.

(10) Patent No.: US 8,141,872 B2
(45) Date of Patent: Mar. 27, 2012

(54) PRINTING APPARATUS HAVING DISCHARGE SPEED CONTROL

(75) Inventors: Yukihiro Maeda, Ibaraki-ken (JP); Masashi Hara, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 459 days.

(21) Appl. No.: 12/320,163

(22) Filed: Jan. 21, 2009

(65) Prior Publication Data

US 2009/0184466 A1 Jul. 23, 2009

(30) Foreign Application Priority Data

Jan. 22, 2008 (JP) ..... 2008-011784

(51) Int. Cl.
*B65H 5/34* (2006.01)

(52) U.S. Cl. ..... 271/270; 271/176

(58) Field of Classification Search ..... 271/270, 271/264, 265.01

See application file for complete search history.

(56) References Cited

U.S. PATENT DOCUMENTS 4,693,461 A * 9/1987 Takahashi ..... 271/176

FOREIGN PATENT DOCUMENTS

JP S64-29343 U 2/1989

* cited by examiner

*Primary Examiner* — Gerald McClain
*Assistant Examiner* — Thomas Morrison
(74) *Attorney, Agent, or Firm* — The Nath Law Group; Jerald L. Meyer; Stanley N. Protigal

(57) ABSTRACT

A printing apparatus comprises: a first paper discharge roller unit 411 and a second paper discharge roller unit 412 which are configured to transport a print sheet to a discharge port; a upper transportation roller unit 401 configured to transport the print sheet to the first paper discharge roller unit 411; a drive control unit 302 configured to determine a transportation speed; an upper side paper discharge drive unit 270 configured to drive both the paper discharge roller units at the determined transportation speed after starting transportation of the print sheet until the print sheet leaves the upper transportation roller unit 401, and drive both the paper discharge roller units at a discharge speed which is determined independently from the transportation speed until the print sheet leaves the second paper discharge roller unit 412.

11 Claims, 11 Drawing Sheets

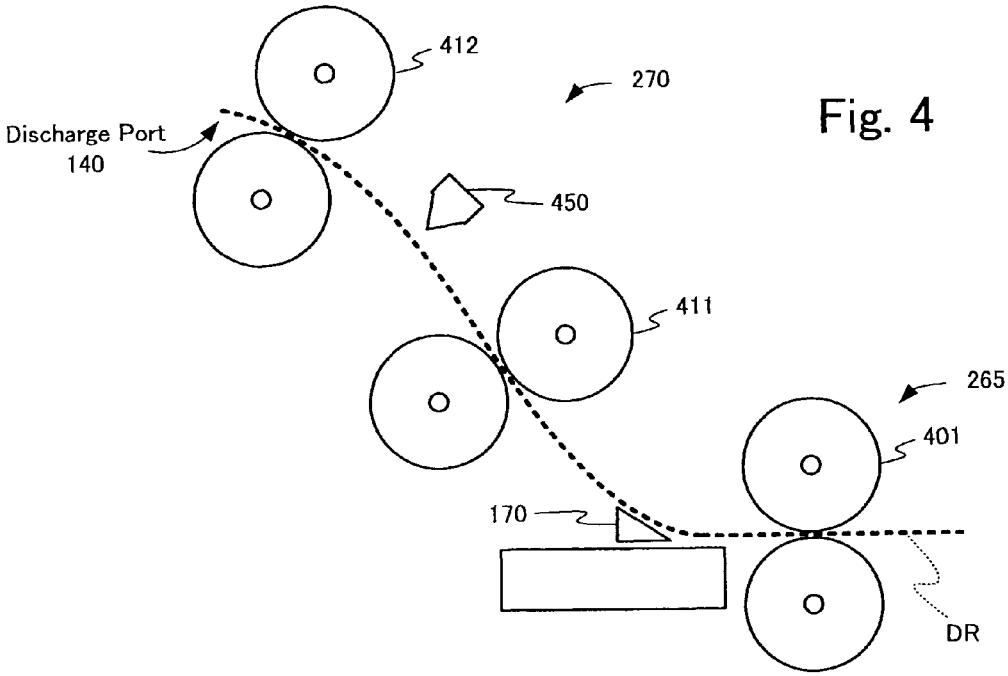
Fig. 4
Fig. 5
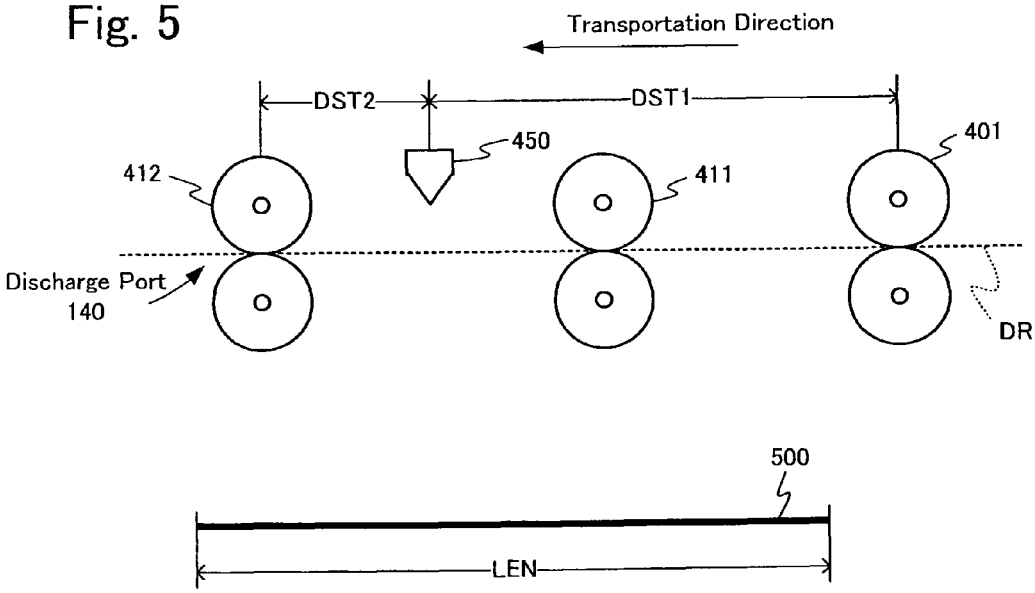

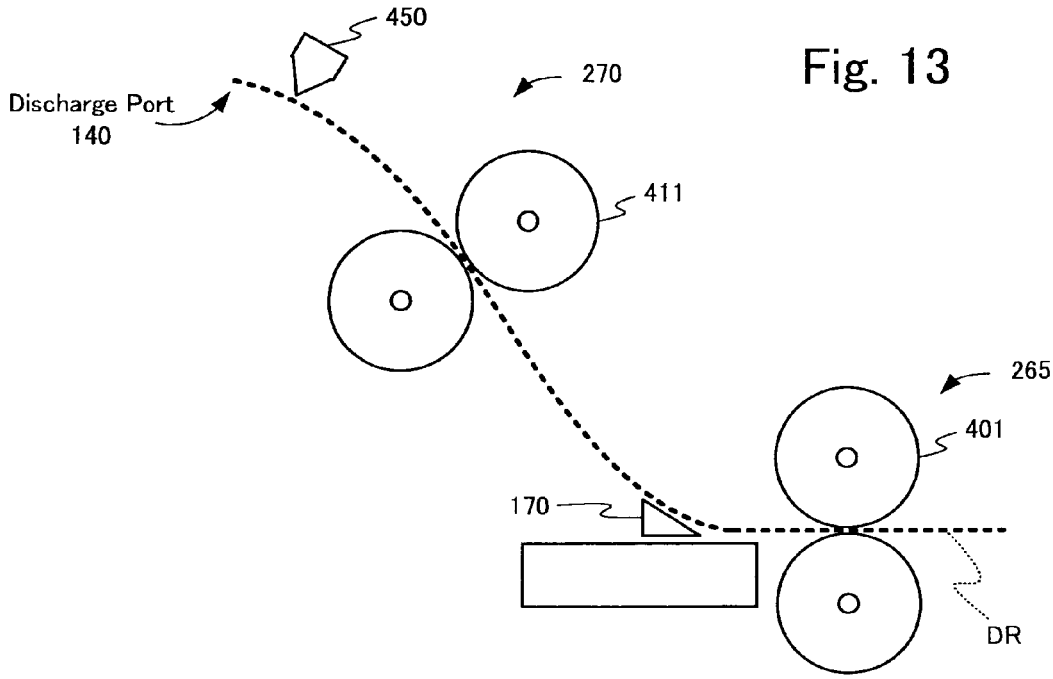
Fig. 13
Fig. 14
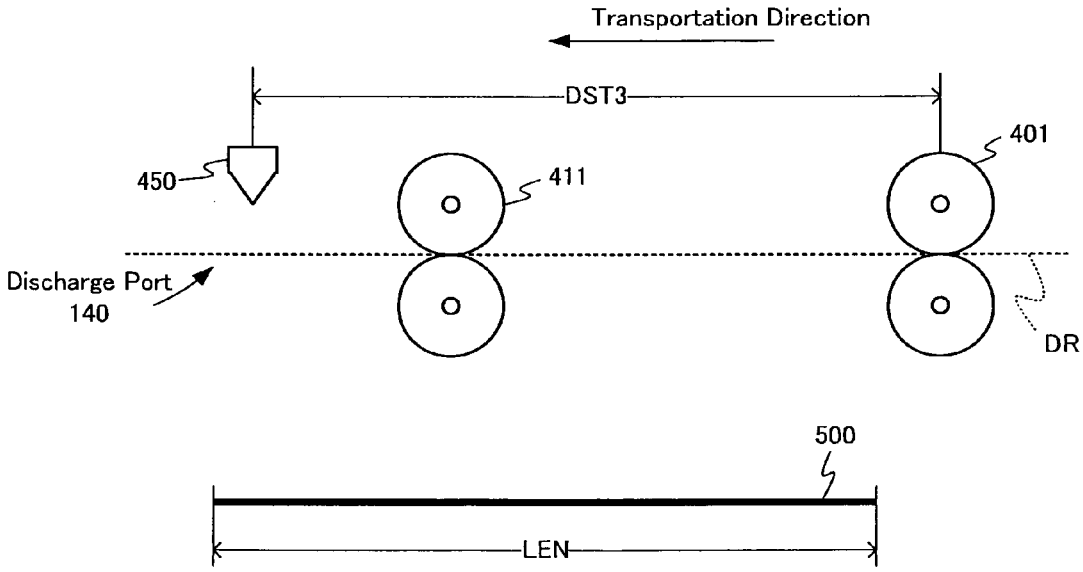

PRINTING APPARATUS HAVING DISCHARGE SPEED CONTROL

BACKGROUND OF THE INVENTION

1. Field of the Invention

The present invention relates generally to a printing apparatus, and in particular relates to the control of discharging paper.

2. Description of the Background Art

Japanese Utility Model Published Application No. Sho 64-29343 discloses a printing apparatus comprising: a paper feed unit for feeding a sheet, a transportation unit for transporting the sheet fed from the paper feed unit to a predetermined location, a discharge unit for discharging the sheet transported from the transportation unit. The printing apparatus is provided with a detection unit for detecting the length of the sheet to be transferred to the discharge unit, a sensor for detecting the sheet received by the discharge unit, a discharge rotary unit for discharging the sheet detected by the sensor from the discharge unit, a control unit for reducing the rotation speed of the discharge rotary unit when the sheet is transported by the distance which is shorter than the distance corresponding to the length of the sheet after the sensor detects the leading edge of the sheet.

As described in this publication, it is a known technique that, in order not to roughly stack print sheets which are successively discharged to the catch tray of the printing apparatus, the transportation speed of the print sheets being discharged is reduced to a lower speed by decelerating a paper discharge roller unit when discharging the print sheets. By this configuration, it is possible to neatly arrange the stacked print sheet discharged onto the catch tray.

Generally speaking, there are a plurality of transfer roller units on the transportation route of the print sheet. Because of this, in a certain location of the transportation route, a print sheet is transported by a plurality of transfer roller units at the same time. Also, a print sheet is transferred between adjacent roller units. In this situation, if the roller unit near the catch tray is simply slowed down, there is a problem in that the print sheet is warped and deformed because of the differential speed between the roller units transporting the print sheet and that a loud hitting sound is caused when the print sheet comes in contact with the roller rotating at a different speed. Furthermore, the transportation speed before speed reduction varies depending on the printer option settings. Particularly, there is a substantial restriction on the transportation speed in the case of double-side printing which requires circulation of the print sheet in the housing of the printing apparatus. Because of this, the timing control of the speed reduction of the paper discharge roller unit cannot uniformly be made, but must be made by taking a variety of factors into consideration.

SUMMARY OF THE INVENTION

Taking into consideration the above circumstances, it is an object of the present invention to provide a printing apparatus capable of switching the speeds of paper discharge rollers with appropriate timing.

In order to accomplish the object as described above, the printing apparatus in accordance with the present invention comprises: a paper discharge roller unit configured to transport a print sheet to a discharge port; a transportation roller unit configured to transport the print sheet to the paper discharge roller unit; a transportation speed determination unit configured to determine a transportation speed at which the transportation roller unit is driven; and a paper discharge roller drive unit configured to drive the paper discharge roller unit at the transportation speed determined by the transportation speed determination unit during the time that the print sheet is being transported by the transportation roller unit, and then drive the paper discharge roller unit at a discharge speed which is determined independently from the transportation speed after the print sheet has left the transportation roller unit while the print sheet is being transported by the paper discharge roller.

In accordance with the present invention, since the paper discharge roller unit is driven at the determined transportation speed until the print sheet leaves the transportation roller unit, it is possible to prevent a loud hitting sound from being caused when the print sheet comes in contact with the paper discharge roller unit, and prevent the print sheet from being warped because of the differential speed between these roller units.

More specifically speaking, there are provided, as the paper discharge roller unit, a first paper discharge roller unit located near the transportation roller unit and a second paper discharge roller unit located near the discharge port, wherein a print sheet sensor is provided between the first paper discharge roller unit and the second paper discharge roller unit, and wherein the paper discharge roller drive unit detects when the print sheet leaves the transportation roller unit on the basis of the detection result by the print sheet sensor, the distance between the sensing position of the print sheet sensor and the transportation roller unit, the length of the print sheet in the transportation direction, and the transportation speed determined by the transportation speed determination unit.

Furthermore, the paper discharge roller drive unit detects when the print sheet leaves the paper discharge roller unit on the basis of the detection result by the print sheet sensor, the distance between the sensing position of the print sheet sensor and the second paper discharge roller unit, and the discharge speed.

Preferably, there is a space between the transportation roller unit and the first paper discharge roller for allowing the print sheet, which is being transported, to warp in the space.

In accordance with another aspect of the present invention, a print sheet sensor is provided between the discharge roller unit and the discharge port, and wherein the paper discharge roller drive unit detects when the print sheet leaves the transportation roller unit on the basis of the detection result by the print sheet sensor, the distance between the transportation roller unit and the sensing position of the print sheet sensor, the length of the print sheet in the transportation direction, and the transportation speed determined by the transportation speed determination unit. Furthermore, the paper discharge roller drive unit detects when the print sheet leaves the paper discharge roller unit on the basis of the detection result by the print sheet sensor.

Also, a circulating transportation route is provided for causing the print sheet to circulate in the housing of the printing apparatus, and wherein the transportation speed determination unit determines the transportation speed to be equivalent to the discharge speed in the case where the print sheet is not circulated around the circulating transportation route. This is because little constraint is imposed on the transportation speed when printing without circulation transportation, and thereby the print sheet can be transported at the speed equivalent to the discharge speed. Also, in any cases, a print transportation drive unit is provided for transporting the print sheet for actual printing (i.e., during spraying ink on paper), and the transportation speed is determined to be higher than the speed of the print sheet which is transported by the print transportation drive unit for printing. In this case, the speed of transporting the print sheet during spraying ink on the print sheet is determined on the basis of a printer option which is selected by the user, and the transportation speed is determined in accordance with a print schedule which is determined in advance of printing with respect to the order of print tasks and the interval between adjacent print tasks.

In accordance with the present invention, it is possible to provide a printing apparatus capable of switching the speeds of the paper discharge roller unit with appropriate timing. Furthermore, even in the case where the circulation transportation speed differs from the speed for actual printing, it is possible to stack print sheets, which have been printed, on the catch tray in a neatly aligned manner.

BRIEF DESCRIPTION OF THE DRAWINGS

The objects and features of the present invention will become more apparent from consideration of the following detailed description taken in conjunction with the accompanying drawings in which:

FIG. 4 is a schematic diagram for showing a paper discharge transportation route near the discharge port of the printing apparatus in accordance with the first embodiment of the present invention.

FIG. 5 is a view for explaining the spatial relationship of an upper transportation roller unit, a first paper discharge roller unit, a second paper discharge roller unit and a discharge sensor of the printing apparatus in accordance with the first embodiment of the present invention.

FIG. 13 is a schematic diagram for showing a paper discharge transportation route near the discharge port of the printing apparatus in accordance with a second embodiment of the present invention.

FIG. 14 is a view for explaining the spatial relationship of an upper transportation roller unit, a first paper discharge roller unit, and a discharge sensor of the printing apparatus in accordance with the second embodiment of the present invention.

DESCRIPTION OF THE PREFERRED EMBODIMENTS

Figure 1:
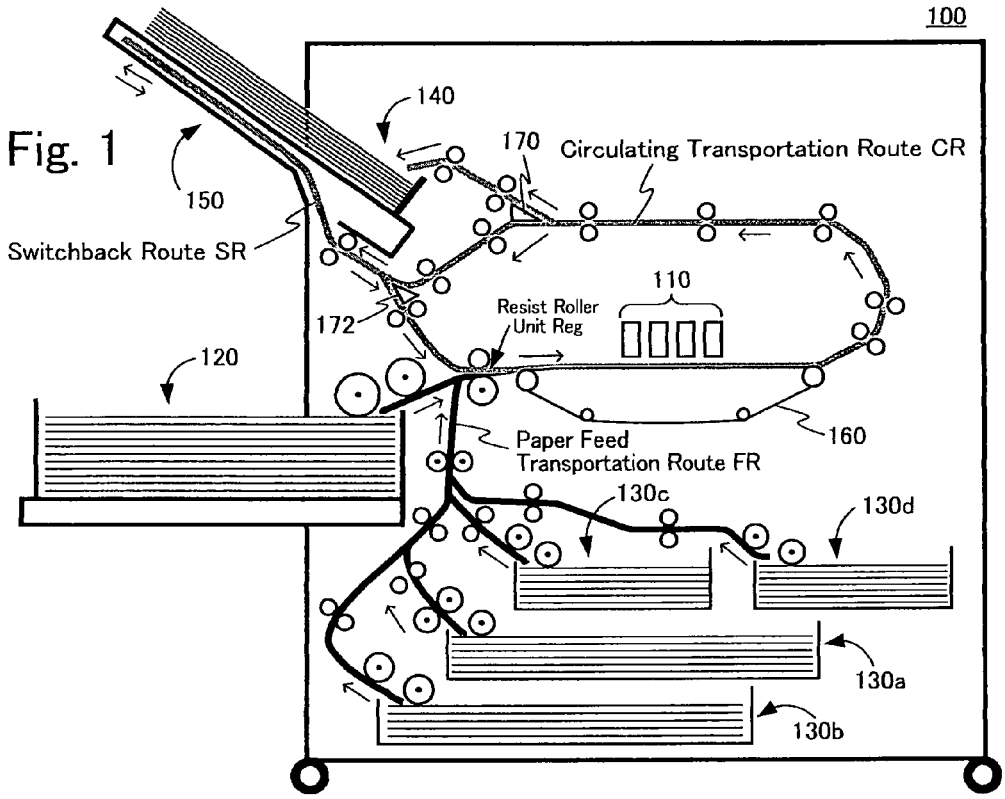
FIG. 1 is a schematic diagram for showing a print sheet transportation route of a printing apparatus in accordance with a first embodiment of the present invention.

In the following description, an embodiment of the present invention will be explained in conjunction with the accompanying drawings. FIG. 1 is a schematic diagram for showing a print sheet transportation route of a printing apparatus 100 in accordance with the present invention. As shown in the same figure, the printing apparatus 100 is provided with a paper feed mechanism for feeding print sheets including a paper feed side tray 120 exposed from the side surface of the housing of the printing apparatus 100, a plurality of paper feed trays 130*a*, 130*b*, 130*c* and 130*d* which are located inside the housing. Furthermore, a discharge port 140 is provided as a discharge mechanism for discharging print sheets which have been printed.

In the case of the present embodiment, the printing apparatus 100 is a line color inkjet printer provided with a plurality of print heads 110 each of which is elongated in the direction perpendicular to the paper transportation direction, and serves to eject black or color ink respectively in order to print images of the respective colors on a line-by-line basis. However, the present invention is not limited to a line inkjet printer, but also applicable to other types of printing apparatuses. For example, the present invention can be applied to serial inkjet printers, laser printers and so forth.

A print sheet fed from either the paper feed side tray 120 or one of the paper feed trays 130 is transported along a paper feed transportation route FR by a transportation mechanism such as roller units to a resist roller unit Reg which defines a reference position at which the leading edge of each print sheet is aligned. The head units 110 having a plurality of print heads are located in the downstream side of the paper transportation route as seen from the resist roller unit Reg. The print sheet is printed to form an image with ink ejected from the respective print heads on a line-by-line basis, while being transported at a predetermined speed in accordance with the printer option settings on a conveyor belt 160 which is located on the opposite side to the print heads 110.

The print sheet which has been printed is further transported in the housing by the transportation mechanism such as roller units. In the case of one-side printing for printing only one side of the print sheet, the print sheet is transferred directly to the discharge port 140 and stacked on a catch tray 150 as a receiver at the discharge port 140 with the printed side down. The catch tray 150 is provided to protrude from the housing with a certain thickness.

The catch tray 150 is slanted with a lower upright wall at which print sheets which have been printed are neatly aligned with the upright wall serving as a reference of alignment. By this configuration, the print sheets discharged from the discharge port 140 slip and drop in the downward direction of the sloop, and are motion restricted by the above wall and automatically aligned under their own weight. However, if the moving speed of the print sheet discharged from the discharge port 140 is strong, the print sheet may shoot out from the catch tray 150 or may be stacked in a random fashion. Conversely, if the moving speed of the print sheet discharged from the discharge port 140 is insufficient, the print sheet may not slip and drop by a sufficient distance to be neatly arranged on the sloop, and thereby may be stacked in a random fashion. Because of this, there is an appropriate range in which the discharge speed from the discharge port 140 is to be controlled. This appropriate range has only an upper limit or both an upper limit and a lower limit in many cases, but may have only a lower limit in some cases.

In the case of double-side printing for printing both sides of the print sheet, the print sheet is not transferred to the discharge port 140 just after printing the main side (the first printed side is called "main side", and the next printed side is called "back side" in this description), but is transported again in the housing. Because of this, the printing apparatus 100 is provided with a shunt mechanism 170 for selectively switching the transfer route for printing on the back side. After printing on the main side, the shunt mechanism 170 transfers the print sheet to a switchback route SR such that the print sheet is reversed with respect to the transportation route by the switchback operation. The print sheet is transferred to the resist roller unit Reg again by the transportation mechanism such as roller units through a shunt mechanism 172, and printed on the back side in the same manner as on the main side. After printing on the back side, the print sheet with images printed on the both sides is transferred to the discharge port 140, and stacked on the catch tray 150 serving as the receiver at the discharge port 140.

Incidentally, in the case of the present embodiment, the switchback operation is performed in the double-side printing mode by the use of the space formed in the lower portion of the catch tray 150. The space formed in the lower portion of the catch tray 150 is designed such that the print sheet cannot be accessed externally during the switchback operation. By this configuration, it is avoided that a user extracts the print sheet during the switchback operation by mistake. On the other hand, since the catch tray 150 is indispensable for the printing apparatus 100, there is no need for a separate space, which would be particularly provided in the printing apparatus 100 for the switchback operation, while making use of the space formed in the lower portion of the catch tray 150 for the switchback operation. Accordingly, it is possible to prevent the size of the housing from increasing for the purpose of implementing the switchback operation. Furthermore, since the discharge port and the switchback route are separated, the paper discharge operation can be performed in parallel with the switchback operation.

In the double-side printing mode of the printing apparatus 100, the print sheet is transferred to the resist roller unit Reg, which defines the reference position at which the leading edge of the print sheet is aligned, not only before printing the main side thereof but also before printing the back side. Because of this, just before the resist roller unit Reg, there is a junction point between the transportation route for the print sheet just fed from the paper feed side tray and the transportation route for the print sheet with the main side having been printed.

Figure 2:
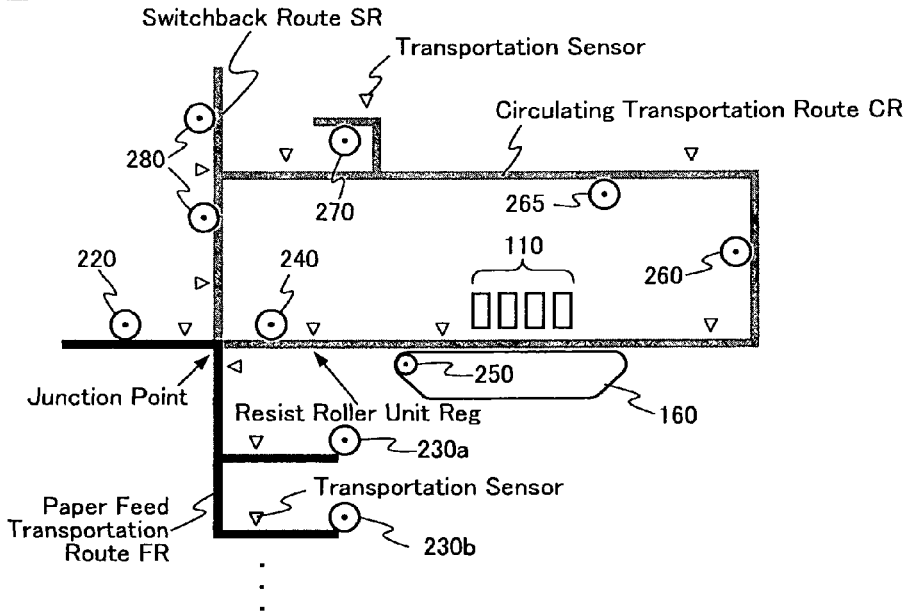
FIG. 2 is a diagram for schematically showing a paper feed transportation route and a circulating transportation route in accordance with the first embodiment of the present invention.

The paper transportation route is divided into the paper feed transportation route FR, which is located on the paper feed mechanism side as seen from this junction point, and the remaining circulating transportation route CR. FIG. 2 is a diagram for schematically showing the paper feed transportation route FR and the circulating transportation route CR. Some of roller units forming the transportation mechanism are not illustrated for the sake of clarity in explanation.

The paper feed transportation route FR is provided with a side paper feed drive unit 220 for feeding paper from the paper feed side tray 120, and a first tray drive unit 230*a*, a second tray drive unit 230*b*, . . . respectively for feeding paper from the paper feed trays 130*a*, 130*b*, 130*c* and 130*d*. Each transportation unit comprises a transportation mechanism constructed by a plurality of roller units to extract print sheets one after another from the paper feed tray corresponding thereto and transfer the print sheets to the resist roller unit Reg. The respective transportation units can be driven independently from each other, and perform necessary operation in order to implement the paper feed mechanism.

In addition, the paper feed transportation route FR is provided with a plurality of transportation sensors with which paper jam can be detected along the paper feed transportation route FR. Each transportation sensor is a sensor which can determine if a print sheet is present and detect the leading edge of the print sheet. For example, the plurality of transportation sensors are located on the paper feed transportation route at appropriate intervals. Paper jam can be detected if the transportation sensor located on the transportation side does not detect the print sheet a predetermined time after the transportation sensor located on the paper feeding side detects the print sheet. Furthermore, paper jam (paper feeding error) can also be detected if the transportation sensor located near the paper feed tray does not detect the print sheet a predetermined time after starting driving the side paper feed drive unit 220, the first tray drive unit 230*a* or the like.

By providing the transportation sensor near each paper feed tray, it is possible to determine whether or not paper jam occurs in the paper feed transportation route FR, and determine in what location of the paper feed transportation route FR the paper jam occurs.

Along the circulating transportation route CR, there are a resist drive unit 240 for receiving a print sheet at the resist roller unit Reg, a belt drive unit 250 for driving the conveyor belt 160 which is located in a position opposite the head units 110, first and second upper side transportation drive units 260 and 265 which are arranged on the circulating transportation route CR successively in the paper transportation direction, an upper side paper discharge drive unit 270 for transferring a printed sheet to the discharge port 140, and a switch back route drive unit 280 for drawing the printed sheet in the switchback route SR, reversing and transferring the printed sheet to the junction point between the circulating transportation route CR and the paper feed transportation route. Each of these transportation units is provided with a driving mechanism comprising one or more roller units, and serves to transport print sheets one after another along the transportation route. The respective transportation units can be driven independently from each other, and perform necessary operation in accordance with the transportation position of the print sheet.

The circulating transportation route CR is also provided with a plurality of transportation sensors with which paper jam can be detected along the circulating transportation route CR. Furthermore, it can be confirmed that each print sheet is transferred to the resist roller unit Reg in an appropriate manner. A transportation sensor is provided near each transportation unit, and thereby it is possible to determine in what location of the circulating transportation route CR the paper jam occurs.

Meanwhile, in the case of the present embodiment, a print sheet is fed to the printing apparatus 100 in advance of discharging the preceding print sheet, without waiting until the preceding print sheet is discharged, so that print sheets are successively fed and continuously printed at predetermined intervals. Because of this, there may be a plurality of print sheets in the circulating transportation route CR of the printing apparatus 100 at the same time, and a plurality of print sheets in both the circulating transportation route CR and the paper feed transportation route FR at the same time.

Figure 3:
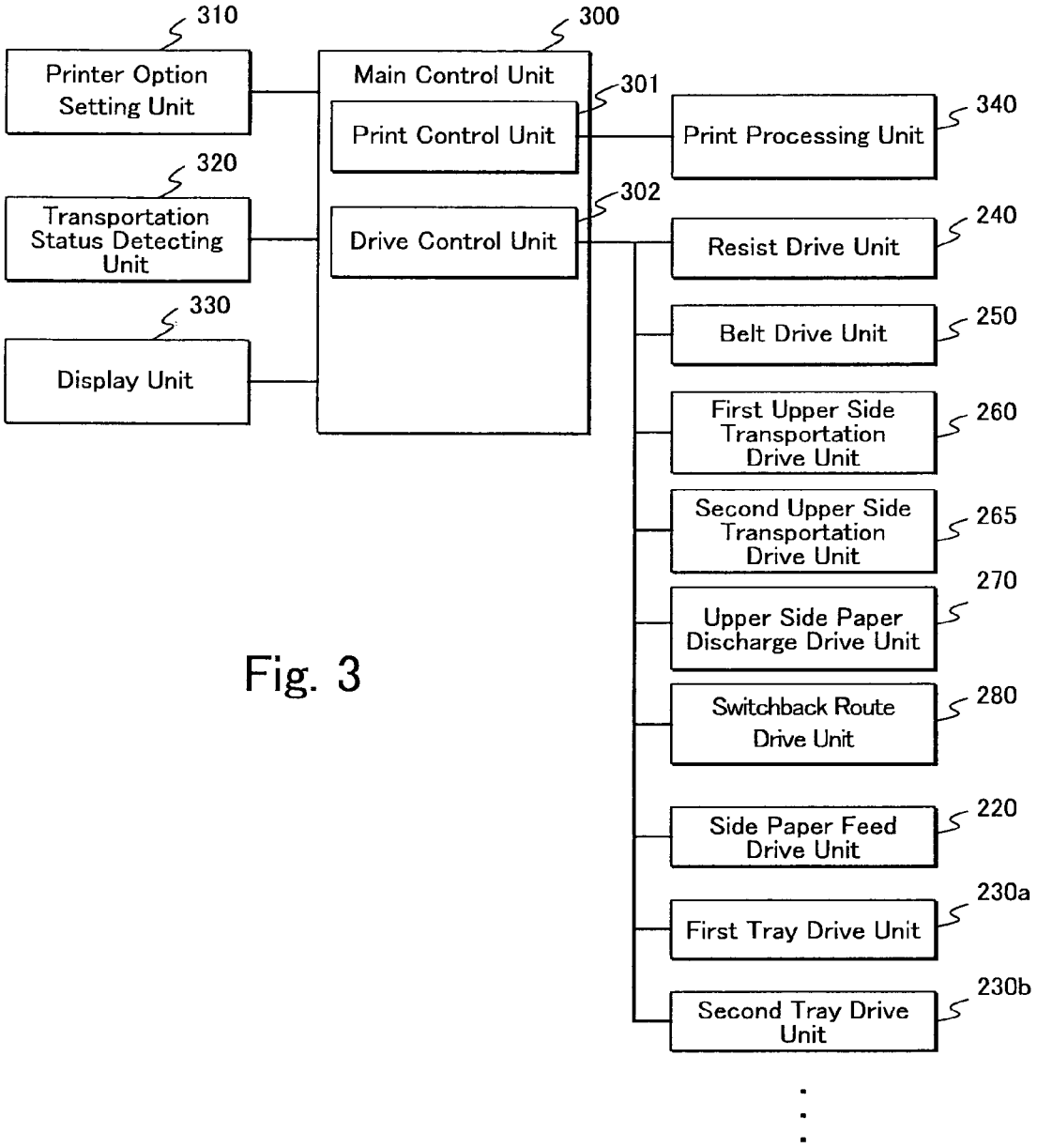
FIG. 3 is a block diagram showing the functional configuration of the printing apparatus in accordance with the first embodiment of the present invention.

FIG. 3 is a block diagram showing the functional configuration of the printing apparatus 100. The printing apparatus 100 is provided with a main control unit 300 which includes a CPU, a memory and the like. The CPU runs a program stored in the memory in order to implement a print control unit 301 and a drive control unit 302.

Also, the printing apparatus 100 is provided further with a printer option setting unit 310 for receiving the settings of double-side or single-side printing, paper size, resolution and so forth, a transportation status detecting unit 320 for detecting the transportation status of the print sheets on the transportation route on the basis of the signals output from the transportation sensors, and a display unit 330 for displaying the information about the status of the printing apparatus. The printer option setting unit 310 receives the print data as transmitted from a computer connected to the printing apparatus 100, and accepts the settings of printer options as input by the user through an input panel (not shown in the figure).

The print control unit 301 generates image data in accordance with the printer option settings accepted by the printer option setting unit 310, and controls the print process performed by a print processing unit 340 comprising the print mechanism such as the print head. The drive control unit 302 drives the respective units as described above (the resist drive unit 240, the belt drive unit 250, the first upper side transportation drive unit 260, the second upper side transportation drive unit 265, the upper side paper discharge drive unit 270, the switchback route drive unit 280, the side paper feed drive unit 220, the first tray drive unit 230*a*, the second tray drive unit 230*b* . . . ) under the control of the print control unit 301.

Next, the transportation route near the discharge port 140 (hereinafter referred to as the paper discharge transportation route DR) will be explained with reference to FIG. 4. As shown in the same figure, the paper discharge transportation route DR is provided with an upper transportation roller unit 401, a first paper discharge roller unit 411 and a second paper discharge roller unit 412. Each of the roller units 401, 411, and 412 is composed of a pair of a driving roller and a driven roller. The upper transportation roller unit 401 is driven by the second upper side transportation drive unit 265, and the first paper discharge roller unit 411 and the second paper discharge roller unit 412 are driven by the upper side paper discharge drive unit 270 at the same rotational speed.

There is a transportation sensor 450 (hereinafter referred to as the discharge sensor 450) for detecting the discharge status between the first paper discharge roller unit 411 and the second paper discharge roller unit 412. The discharge sensor 450 serves to output an ON signal if there is a print sheet in the detection range, and output an OFF signal if there is no print sheet in the detection range. Accordingly, when a print sheet is discharged, the discharge sensor 450 starts outputting the ON signal when the leading edge of the print sheet reaches the position of the discharge sensor 450, and switches the ON signal to the OFF signal after the trailing edge of the print sheet is passed through the position of the discharge sensor 450.

FIG. 5 is a view for explaining the spatial relationship of the upper transportation roller unit 401, the first paper discharge roller unit 411, the second paper discharge roller unit 412 and the discharge sensor 450. While the paper discharge transportation route DR is actually warped as shown in FIG. 4, the paper discharge transportation route DR is illustrated in FIG. 5 as a straight route for the sake of clarity in explanation. As shown in FIG. 5, the distance between the upper transportation roller unit 401 and the discharge sensor 450 is DST1, and the distance between the discharge sensor 450 and the second paper discharge roller unit 412 is DST2. The length of a print sheet 500 is LEN.

Next, the discharge control process performed by the printing apparatus 100 will be explained with reference to the flow chart of FIG. 6. The discharge control process is differently performed between the print process in which the print sheet is discharged just after printing one side, and the print process in which the print sheet is discharged after performing circulation transportation of the print sheet having been printed on one side to the resist roller unit Reg. Because of this, when receiving a print command from the user, it is determined whether or not to perform circulation transportation in step S101. This determination can be performed on the basis of the printer options which are selected by the user.

Typically, the circulation transportation is performed in a double-side printing mode. However, the circulation transportation is performed in another printing mode. For example, even in a one-side printing mode, the print sheet is circulated in the circulating transportation route CR for the purpose of drying the ink printed on the print sheet, and the print sheet is reversed by the switchback operation and circulated in the circulating transportation route CR for the purpose of discharging the print sheet with the printed side up. The print process without the circulation transportation is typically a usual one-side printing mode.

As a result of determining whether or not to perform the circulation transportation, if the circulation transportation is not performed (i.e., the "No" branch from step S101), the paper discharge transportation route DR is driven at a default speed within an appropriate range for discharging a print sheet in step S102. Namely, the upper transportation roller unit 401 and the first paper discharge roller unit 411 are controlled to rotate at such a rotational speed that the print sheet is transported at the range of the speed appropriate for discharging a print sheet (hereinafter referred to as the optimal discharge speed) within the appropriate range for discharging a print sheet. By this configuration, the print sheet can be prevented from shooting out from the catch tray 150 or being stacked in a random fashion. This is because little constraint is imposed on the transportation speed when printing without circulation transportation, and thereby the print sheet can be transported at the optimal discharge speed. However, if there is a constraint imposed on the transportation speed, the following discharge control process may be performed in the same manner as described below in the case where circulation transportation is performed during the print process.

The range of the speed appropriate for discharging a print sheet can be experimentally or theoretically determined on the basis of the configuration of the catch tray 150 and the positional relationship of the discharge port 140 and the catch tray 150. On the other hand, the first upper side transportation drive unit 260 and the second upper side transportation drive unit 265 serve to transport the print sheet 500 having been printed to the paper discharge transportation route DR at the optimal discharge speed which is within this speed range. By this process, the upper transportation roller unit 401 and the first paper discharge roller unit 411 rotate at the same speed, and there is no differential speed therebetween during the transportation of the print sheet 500. Because of this, it is possible to prevent a loud hitting sound from being caused when the print sheet 500 comes in contact with the first paper discharge roller unit 411 during transportation, and prevent the print sheet from being warped and deformed because of the differential speed between these roller units.

Figure 7:
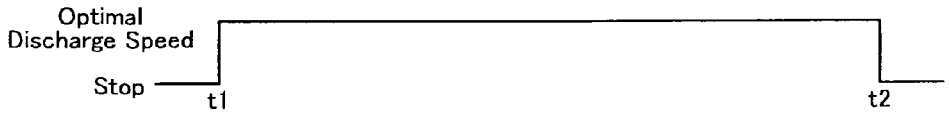
FIG. 7 is a schematic view for showing the waveform of the drive signal which is supplied to the first paper discharge roller unit and the second paper discharge roller unit when the circulation transportation is not used during print operation in accordance with the first embodiment of the present invention.

In the case where the circulation transportation is not performed during the print process, the paper discharge transportation route DR is continuously driven at the optimal discharge speed until transportation is completed in step S103. FIG. 7 is a schematic view for showing the waveform of the drive signal which is supplied to the first paper discharge roller unit 411 and the second paper discharge roller unit 412 in this situation. As shown in the same figure, when the transportation is started at time point t1, the respective roller units are driven to transport the print sheet at the optimal discharge speed, and the drive signal is maintained as it is until transportation is completed at time point t2. Alternatively, the supply of the drive signal may be halted for a while in the middle of the discharge process.

On the other hand, in the case where circulation transportation is performed during the print process (i.e., the"Yes" branch from step S101), the circulation transportation speed is first calculated in step S104. In this example, the calculation of the circulation transportation speed will be explained with reference to FIG. 8A to FIG. 8D on the assumption that the double-side printing is performed.

Figure 8A:
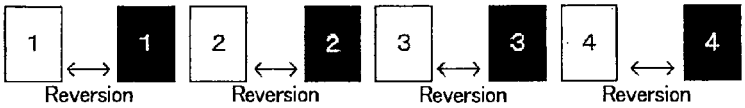
FIG. 8A is a schematic diagram for showing the print schedule in the double-side printing mode in accordance with a prior art technique.

In FIG. 8A to FIG. 8D, N-th main side printing is indicated by a black numeral "N" on a white background, and N-th back side printing is indicated by a white numeral "N" on a black background. Heretofore, when the double-side printing is performed, the first print sheet is reversed after printing on the main side of the first print sheet, and then the back side of the first print sheet is printed as illustrated in FIG. 8A. Thereafter, the second print sheet is fed and printed on the main side, followed by reversing and printing on the back side thereof. The subsequent print sheets are printed in the same manner one sheet after another printed on both sides.

Figure 8B:
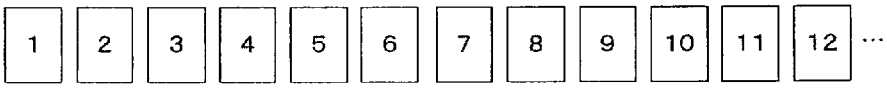
FIG. 8B is a schematic diagram for showing a successive print process in a one-side printing mode in accordance with a prior art technique.
Figure 8C:
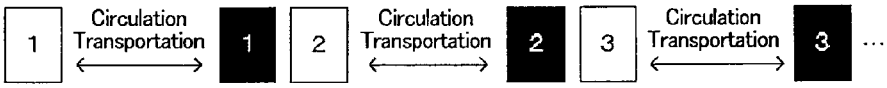
FIG. 8C is a schematic diagram for showing the decrease in the throughput of the print process in the double-side printing mode.

However, in order to reverse the print sheet from the main side to the back side, the print sheet has to be circulated around the circulating transportation route CR shown in FIG. 1, and thereby it takes a certain time. Because of this, even if the printing apparatus is capable of successively printing a number of print sheets, i.e., printing the first sheet, the second sheet, the third sheet and subsequent sheets in the one-side printing mode as illustrated in FIG. 8B, there has to place an interval for circulation transportation between the main side printing and the back side printing, as illustrated in FIG. 8C, such that the print process has to be performed by printing the main side of the first print sheet, making a pause corresponding to the time for printing two sides, printing the back side of the first print sheet, printing the main side of the second print sheet, making a pause corresponding to the time for printing two sides, printing the back side of the second print sheet, and so forth, in the case where it takes the time required for printing two sides to circulate a print sheet around the circulating transportation route CR. The throughput of the print process is thereby substantially decreased.

Figure 8D:
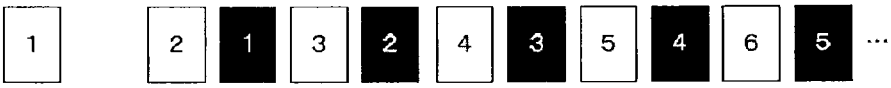
FIG. 8D is a schematic diagram for explaining the print schedule in the double-side printing mode in accordance with the first embodiment of the present invention.

In view of this shortcoming, the print process of the present embodiment is performed to print the main side of the first print sheet, make a pause corresponding to the time for printing one side, print the main side of the second print sheet, print the back side of the circulated first print sheet without a pause as illustrated in FIG. 8D. Thereafter, without a pause, the main side of the third print sheet is printed followed by printing the back side of the circulated second print sheet. By this control, after printing the main side of the second print sheet, the printing throughput in the double-side printing mode can be improved equivalent to that of the one-side printing mode.

Meanwhile, the time required for circulation transportation and the number of print sheets which can be located in the circulating transportation route CR at the same time vary depending on the paper size and the like. Because of this, with respect to the print schedule in the double-side printing mode, the print order of the main and back sides of the respective print sheets is determined in accordance with a predetermined algorithm taking into consideration the printer options which are selected by the user through the printer option setting unit 310. There are several algorithms which can be employed as this predetermined algorithm. However, there is a case where the main side of a print sheet is printed in advance of printing the back side of the previous print sheet which is previously fed.

Then, the circulation transportation speed is calculated for performing this print schedule. For example, the circulation transportation speed has to be determined in order that the first print sheet is circulated in the period from the time when the main side is printed to the time when the main side is to be printed as illustrated in FIG. 8D.

In this case, the circulation transportation speed is determined independently from the transportation speed of the conveyor belt 160 which is directly associated with the print speed. Namely, the transportation speed of the conveyor belt 160 is the speed of the print sheet during printing operation (i.e., during spraying ink on the print sheet), and thereby determined in accordance with the printer options such as the resolution. However, the circulation transportation speed is determined in accordance with the print schedule independently from the transportation speed of the conveyor belt 160. Also, in order not to prevent the print sheet 500 just fed from coming in contact with the print sheet 500 which is circulated at the resist roller unit Reg or the like, the circulation transportation speed is set to a value higher than the transportation speed of the conveyor belt 160.

The circulation transportation speed is calculated for the purpose of improving the throughput, and thereby it does not necessarily fall within the range of the speed appropriate for discharging a print sheet, but rather may be beyond this range in many cases. Also, the discharge port 140 is located in the circulating transportation route CR in which the print sheet 500 is transported at the circulation transportation speed. In accordance with the present embodiment, the discharge control process is performed to control the speed of the print sheet 500 at the optimal discharge speed when discharging the print sheet 500.

Figure 6:
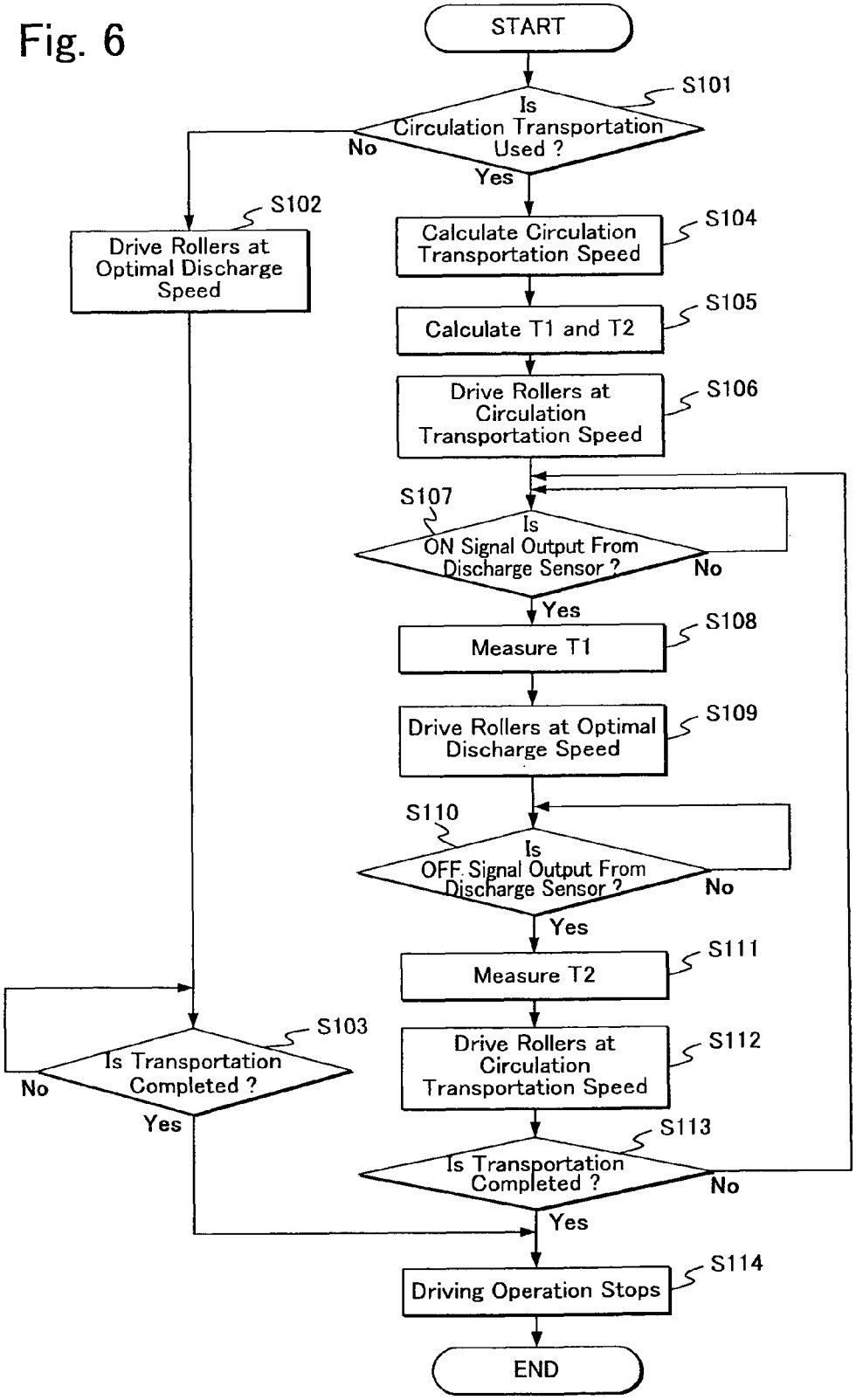
FIG. 6 is a flow chart for explaining the discharge control process performed by the printing apparatus in accordance with the first embodiment of the present invention.

Returning to the flowchart of FIG. 6, after calculating the circulation transportation speed by the process in step S104, time T1 and time T2 are calculated in step S105. The time T1 is the time calculated by Equation 1, and corresponding to the period of time which elapses after the leading edge of the print sheet 500 reaches the discharge sensor 450 until the trailing edge of the print sheet 500 is passed through the upper transportation roller unit 401. On the other hand, the time T2 is the time calculated by Equation 2, and corresponding to the period of time which elapses after the trailing edge of the print sheet 500 reaches the discharge sensor 450 until the trailing edge of the print sheet 500 is passed through the second paper discharge roller unit 412. As described above, DST1 is the distance between the upper transportation roller unit 401 and the discharge sensor 450, DST2 is the distance between the discharge sensor 450 and the second paper discharge roller unit 412, and LEN is the length of the print sheet 500.

$$T1=(LEN-DST1)/(\text{circulation transportation speed}) \quad \text{Equation 1}$$

$$T2=DST2/(\text{optimal discharge speed}) \quad \text{Equation 2}$$

Figure 10A:
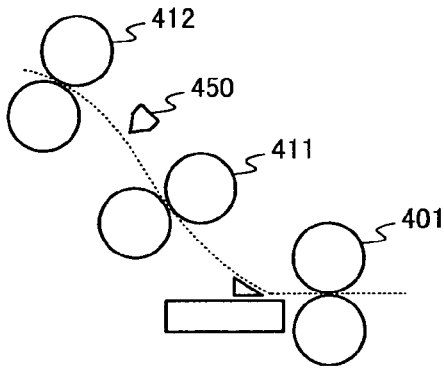
FIG. 10A is a schematic diagram for explaining the situation near the discharge port in the process of discharging a print sheet in accordance with the first embodiment of the present invention.

After calculating time T1 and time T2, the transportation of the print sheet 500 is started to perform the print process in step S106. At this time, the upper transportation roller unit 401, the first paper discharge roller unit 411 and the second paper discharge roller unit 412 are also driven at the circulation transportation speed. In the double-side printing mode, the both sides are printed in accordance with the print schedule. FIG. 10A is a schematic diagram for explaining the situation near the discharge port 140 in this process. As shown in the same figure, the print sheet 500 does not reach the paper discharge transportation route DR yet.

Figure 10B:
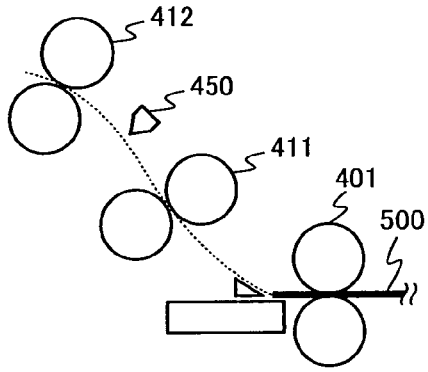
FIG. 10B is a schematic diagram for showing the situation near the discharge port when a print sheet is transferred to the paper discharge transportation route in accordance with the first embodiment of the present invention.

In this case, it is monitored when the discharge sensor 450 outputs an ON signal in step S107. FIG. 10B is a schematic diagram for showing the situation near the discharge port 140 when the print sheet 500 is transferred to the paper discharge transportation route DR. Thereafter, while being transported by the upper transportation roller unit 401, the leading edge of the print sheet 500 reaches the first paper discharge roller unit 411. However, since both the upper transportation roller unit 401 and the first paper discharge roller unit 411 are driven at the circulation transportation speed, it is possible to prevent a loud hitting sound from being caused when the print sheet 500 comes in contact with the first paper discharge roller unit 411 during transportation, and prevent the print sheet from being warped and deformed because of the differential speed between these roller units.

Figure 10C:
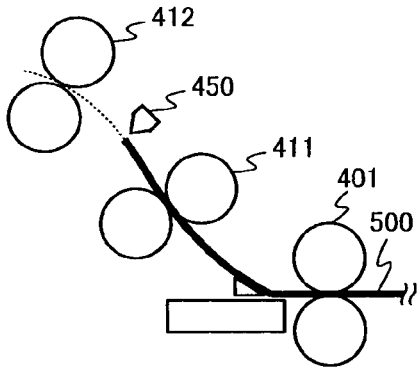
FIG. 10C is a schematic diagram for showing the situation near the discharge port when the leading end of the print sheet reaches the position of the discharge sensor in accordance with the first embodiment of the present invention.

When the leading end of the print sheet 500 having been printed reaches the position of the discharge sensor 450 as illustrated in FIG. 10C, the discharge sensor 450 outputs an ON signal. When detecting the ON signal output from the discharge sensor 450 (i.e., the "Yes" branch from step S107), measurement of the time T1 is started in step S108. The leading edge of the print sheet 500 reaches the second paper discharge roller unit 412 during the measurement of the time T1. However, since the upper transportation roller unit 401, the first paper discharge roller unit 411 and the second paper discharge roller unit 412 are driven at the circulation transportation speed, it is possible to prevent a loud hitting sound from being caused when the print sheet 500 comes in contact with the second paper discharge roller unit 412 during transportation, and prevent the print sheet from being warped and deformed because of the differential speed between these roller units.

Figure 10D:
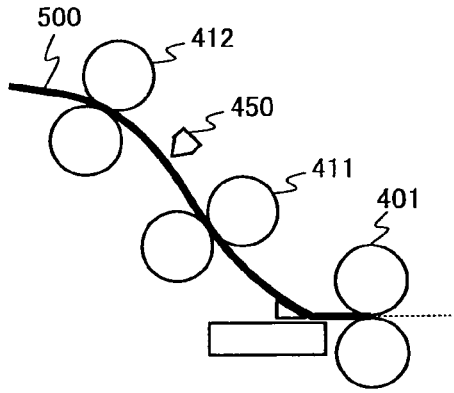
FIG. 10D is a schematic diagram for showing the situation near the discharge port when the trailing edge of the print sheet is passed through the upper transportation roller unit in accordance with the first embodiment of the present invention.

The time T1 elapses when the trailing edge of the print sheet 500 is passed through the upper transportation roller unit 401 as illustrated in FIG. 10D. In other words, when the time T1 has elapsed, the print sheet 500 gets rid of the constraint by the upper transportation roller unit 401. Then, the rotational speeds of the first paper discharge roller unit 411 and the second paper discharge roller unit 412 are switched to the optimal discharge speed in step S109. The rotational speed of the upper transportation roller unit 401 is not changed as it is at the circulation transportation speed. As a result, the upper transportation roller unit 401 and the first paper discharge roller unit 411 rotate at different rotational speeds. However, the print sheet 500 has already been passed through the upper transportation roller unit 401, the print sheet 500 is not warped or stretched. Incidentally, the rotational speeds of the first paper discharge roller unit 411 and the second paper discharge roller unit 412 are not necessarily switched immediately after the time T1 elapsed, but can be switched to the optimal discharge speed at least after the time T1 elapsed.

Figure 10E:
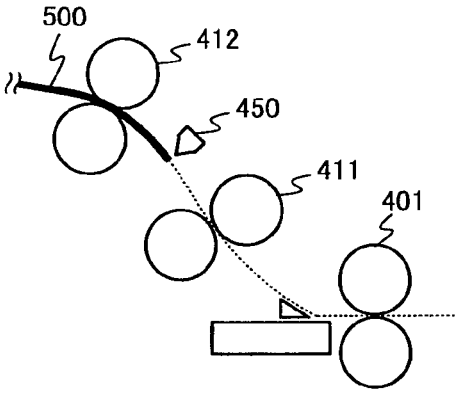
FIG. 10E is a schematic diagram for showing the situation near the discharge port when the trailing edge of the print sheet reaches the position of the discharge sensor in accordance with the first embodiment of the present invention.

After switching the rotational speeds of the first paper discharge roller unit 411 and the second paper discharge roller unit 412 to the optimal discharge speed, it is monitored when the discharge sensor 450 outputs an OFF signal in step S110. As illustrated in FIG. 10E, when the trailing edge of the print sheet 500 reaches the position of the discharge sensor 450, the discharge sensor 450 outputs an OFF signal. When detecting the OFF signal output from the discharge sensor 450 (i.e., the "Yes" branch from step S110), measurement of the time T2 is started in step S111.

Figure 10F:
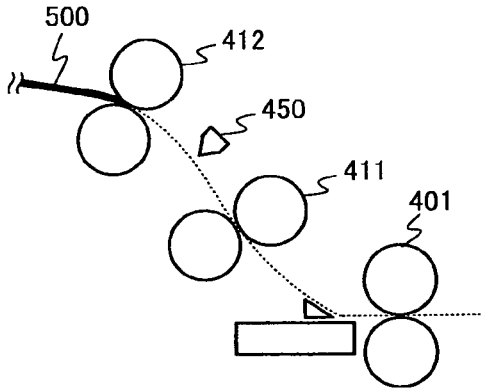
FIG. 10F is a schematic diagram for showing the situation near the discharge port when the trailing edge of the print sheet is passed through the first paper discharge roller unit followed by discharging the print sheet through the discharge port in accordance with the first embodiment of the present invention.

When the time T2 has elapse, as illustrated in FIG. 10F, the trailing edge of the print sheet 500 is passed through the second paper discharge roller unit 412 followed by discharging the print sheet 500 through the discharge port 140. At this time, since the second paper discharge roller unit 412 rotates at the optimal discharge speed, the print sheet 500 is discharged at the optimal discharge speed. Because of this, the print sheet can be prevented from shooting out from the catch tray 150 or being stacked in a random fashion.

After the time T2 elapses, the discharge process is completed. Then, the rotational speeds of the first paper discharge roller unit 411 and the second paper discharge roller unit 412 are switched to the circulation transportation speed in step S112. The process as discussed above is repeated until the transportation is completed in step S113. When the transportation of all the print sheets 500 is completed (i.e., the "Yes" branch from step S113), the operation of each driving unit is stopped in step S114. Meanwhile, the rotational speeds of the first paper discharge roller unit 411 and the second paper discharge roller unit 412 are not necessarily switched immediately after the time T2 elapsed, but can be switched to the optimal discharge speed at least after the time T2 elapsed.

Figure 9:
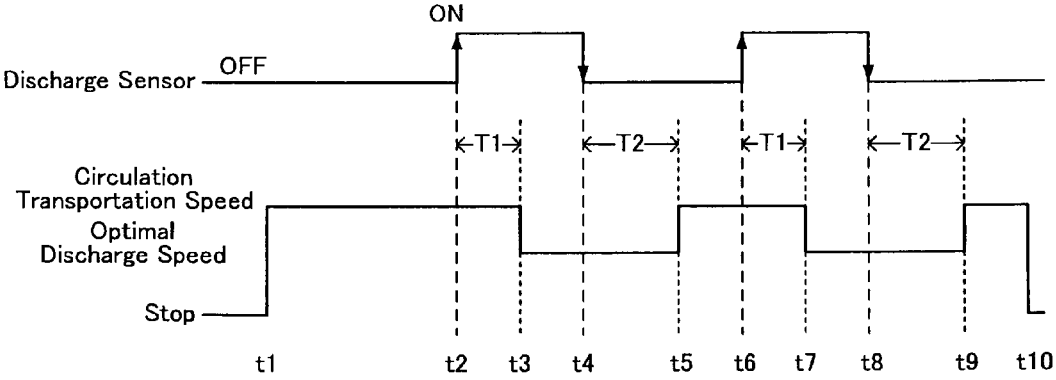
FIG. 9 is a graphic diagram for showing the waveform of the output signal of the discharge sensor and the waveform of the drive signal to be supplied to the first paper discharge roller unit and the second paper discharge roller unit in the case where the circulation transportation is performed in accordance with the first embodiment of the present invention.

FIG. 9 is a graphic diagram for showing the waveform of the output signal of the discharge sensor 450 and the waveform of the drive signal to be supplied to the first paper discharge roller unit 411 and the second paper discharge roller unit 412 in the case where the circulation transportation is performed. In this case as illustrated in FIG. 9, two print sheets are discharged. When the transportation is started at time point t1, the first paper discharge roller unit 411 and the second paper discharge roller unit 412 are driven to transport the print sheet at the circulation transportation speed, and get ready for receiving the first print sheet 500. When the discharge sensor 450 outputs an ON signal at the time point t2, measurement of the time T1 is started. When the time T1 has elapsed at time point t3, the first paper discharge roller unit 411 and the second paper discharge roller unit 412 are driven to transport the print sheet 500 at the optimal discharge speed. When the discharge sensor 450 outputs an OFF signal at time point t4, measurement of the time T2 is started. During the time T2, the first print sheet 500 is discharged.

When the time T2 has elapsed at time point t5, the first paper discharge roller unit 411 and the second paper discharge roller unit 412 are driven to transport the print sheet 500 at the circulation transportation speed, and get ready for receiving the second print sheet 500. When the discharge sensor 450 outputs an ON signal at time point t6, measurement of the time T1 is started. When the time T1 has elapsed at time point t7, the first paper discharge roller unit 411 and the second paper discharge roller unit 412 are driven to transport the print sheet 500 at the optimal discharge speed. When the discharge sensor 450 outputs an OFF signal at time point t8, measurement of the time T2 is started. During the time T2, the second print sheet 500 is discharged. When the time T2 has elapsed at time point t9, the first paper discharge roller unit 411 and the second paper discharge roller unit 412 are driven to transport the print sheet 500 at the circulation transportation speed. However, since all the print sheets 500 have been completely transported, the operation of driving the roller units is stopped at time point t10.

Figure 11:
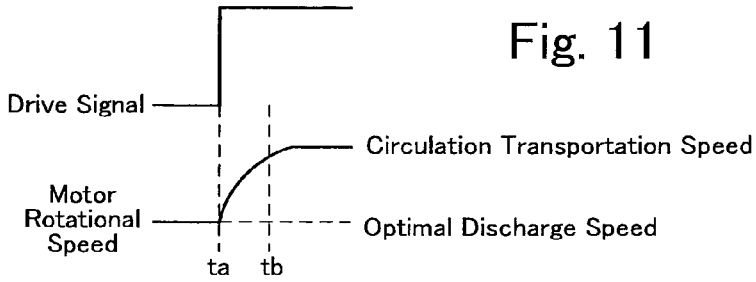
FIG. 11 is a view for explaining the relationship between the drive signal and the rotational speed of a motor as converted into the circumferential speed.

Meanwhile, even if the drive signals are supplied as illustrated in FIG. 9, the first paper discharge roller unit 411 and the second paper discharge roller unit 412 may not immediately follow these drive signals depending upon the characteristics of the system and the environment. For example, even if the drive signal supplied to transport the print sheet 500 at the optimal discharge speed is switched at time point ta to transport the print sheet 500 at the circulation transportation speed, the rotation of the driven motor is increased to transport the print sheet 500 at the circulation transportation speed only at time point tb as illustrated in FIG. 11. In such a case, for example, the print sheet 500 is transferred from the upper transportation roller unit 401 before the speed of the first paper discharge roller unit 411 is increased to the circulation transportation speed at time point t5 shown in FIG. 9. As a result, the print sheet 500 reaches and is drawn by the first paper discharge roller unit 411, while the upper transportation roller unit 401 and the first paper discharge roller unit 411 rotate at different rotational speeds, so that the print sheet 500 is warped. Taking into consideration such a situation, in the case of the present embodiment, there is a space between the upper transportation roller unit 401 and the first paper discharge roller unit 411 for allowing the print sheet 500 to warp. This space can be provided above the transportation route.

Figure 12:
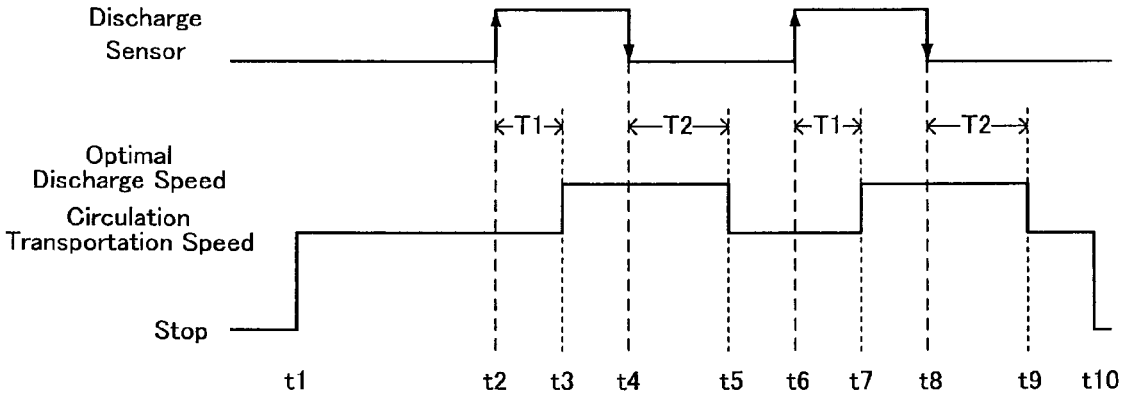
FIG. 12 is a graphic diagram for showing other examples of the waveform of the output signal of the discharge sensor and the waveform of the drive signal to be supplied to the first paper discharge roller unit and the second paper discharge roller unit in the case where the circulation transportation is performed in accordance with the first embodiment of the present invention.

Also, in the case of the above example, it is assumed that the optimal discharge speed is lower than the circulation transportation speed. However, in some situation, the optimal discharge speed may not be lower than the circulation transportation speed. In this case, as illustrated in FIG. 12, the first paper discharge roller unit 411 and the second paper discharge roller unit 412 are controlled to increase the drive signals for the optimal discharge speed to be larger than the drive signals for the circulation transportation speed. The measurement of the time T1 and the time T2 and the timing of outputting the drive signals can be performed in the same manner as in the above example.

In the above example, as illustrated in FIG. 4, the upper side paper discharge drive unit 270 drives the first paper discharge roller unit 411 and the second paper discharge roller unit 412. Next, a second embodiment of the present invention will be explained in the case where the upper side paper discharge drive unit 270 drives a single roller unit comprising a pair of rollers. FIG. 13 is a schematic diagram for showing the paper discharge transportation route DR in which only the first paper discharge roller unit 411 is provided while the second paper discharge roller unit 412 of the first embodiment is dispensed with. As shown in the same figure, in accordance with the second embodiment, the paper discharge transportation route DR is provided with the upper transportation roller unit 401 and the first paper discharge roller unit 411. Each of the roller units 401 and 411 is composed of a pair of a driving roller and a driven roller. The upper transportation roller unit 401 is driven by the second upper side transportation drive unit 265, and the first paper discharge roller unit 411 is driven by the upper side paper discharge drive unit 270.

There is a discharge sensor 450 for detecting the discharge status between the first paper discharge roller unit 411 and the discharge port 140. The discharge sensor 450 serves to output an ON signal if there is a print sheet in the detection range, and output an OFF signal if there is no print sheet in the detection range. Accordingly, when a print sheet is discharged, the discharge sensor 450 starts outputting the ON signal when the leading edge of the print sheet reaches the position of the discharge sensor 450, and switches the ON signal to the OFF signal after the trailing edge of the print sheet is passed through the position of the discharge sensor 450. The discharge sensor 450 is located in the vicinity of the discharge port 140. When the output signal of the discharge sensor 450 is switched from an ON signal to an OFF signal, it is indicated that a print sheet is discharged.

FIG. 14 is a view for explaining the spatial relationship of the upper transportation roller unit 401, the first paper discharge roller unit 411, and the discharge sensor 450. In the case of the present embodiment, the distance between the upper transportation roller unit 401 and the discharge sensor 450 is DST3. The length of a print sheet 500 is LEN in the same manner as in the first embodiment.

Figure 15:
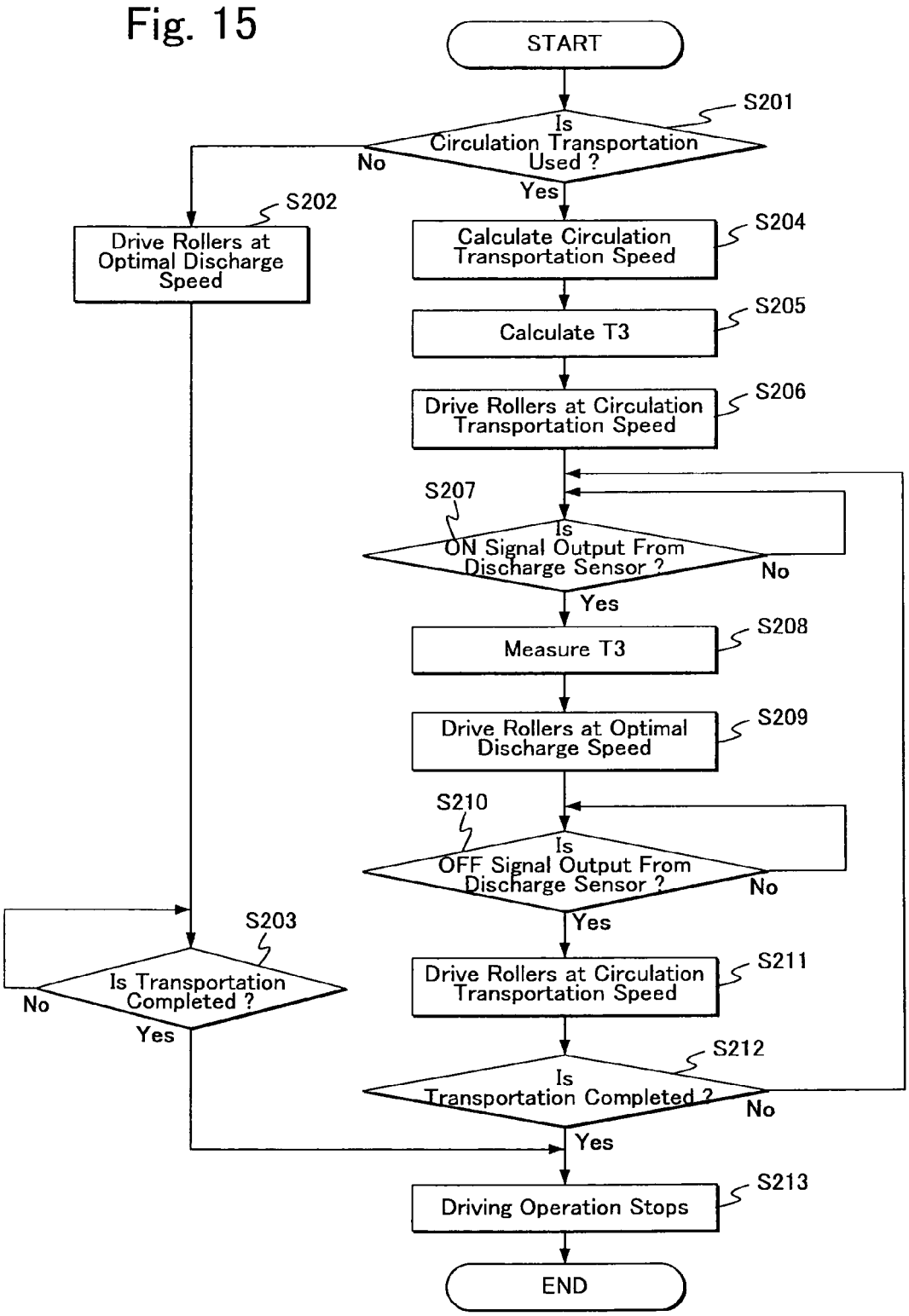
FIG. 15 is a flow chart for explaining the discharge control process performed by the printing apparatus in accordance with the second embodiment of the present invention.

Next, the discharge control process performed by the printing apparatus 100 will be explained in accordance with the second embodiment with reference to the flow chart of FIG. 15. Similar description as in the first embodiment is simplified. In the discharge control process, when receiving a print command from the user, it is determined whether or not to perform circulation transportation in step S201. This determination can be performed on the basis of the printer options which are selected by the user.

As a result of determining whether or not to perform the circulation transportation, if the circulation transportation is not performed (i.e., the "No" branch from step S201), the paper discharge transportation route DR is driven at a default speed within an appropriate range for discharging a print sheet in step S202. Namely, the upper transportation roller unit 401 and the first paper discharge roller unit 411 are controlled to rotate at such a rotational speed that the print sheet is transported at the optimal discharge speed for discharging a print sheet. By this configuration, the print sheet can be prevented from shooting out from the catch tray 150 or being stacked in a random fashion. The paper discharge transportation route DR is continuously driven at the optimal discharge speed until transportation is completed in step S203.

On the other hand, in the case where circulation transportation is performed during the print process (i.e., the"Yes" branch from step S201), the circulation transportation speed is first calculated in step S204. The calculation of the circulation transportation speed can be performed in the same manner as the first embodiment. After calculating the circulation transportation speed, the time T3 is calculated in step S205. The time T3 is the time calculated by Equation 3, and corresponding to the period of time which elapses after the leading edge of the print sheet 500 reaches the discharge sensor 450 until the trailing edge of the print sheet 500 is passed through the upper transportation roller unit 401. As described above, DST3 is the distance between the upper transportation roller unit 401 and the discharge sensor 450, and LEN is the length of the print sheet 500. Meanwhile, in the case where the length of the print sheet is so short that LEN<DST3, the time T3=0.

$$T3=(LEN-DST3)/(\text{circulation transportation speed}) \qquad \text{Equation 3}$$

Figure 17A:
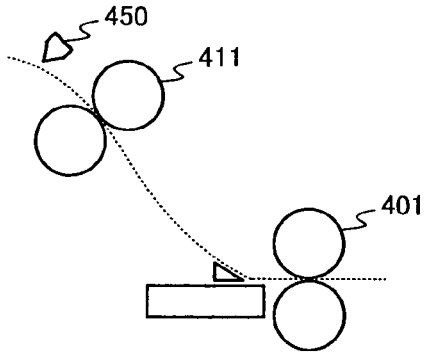
FIG. 17A is a schematic diagram for explaining the situation near the discharge port in the process of discharging a print sheet in accordance with the second embodiment of the present invention.

After calculating time T3, the transportation of the print sheet 500 is started to perform the print process in step S206. At this time, the upper transportation roller unit 401 and the first paper discharge roller unit 411 are also driven at the circulation transportation speed. In the double-side printing mode, the both sides are printed in accordance with the print schedule. FIG. 17A is a schematic diagram for explaining the situation near the discharge port 140 in this process. As shown in the same figure, the print sheet 500 does not reach the paper discharge transportation route DR yet.

Figure 17B:
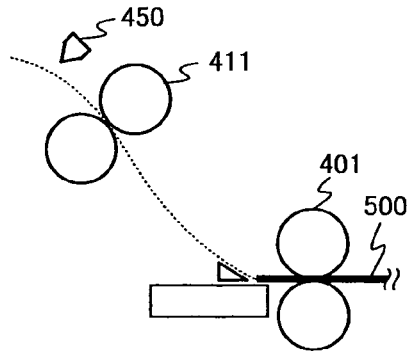
FIG. 17B is a schematic diagram for showing the situation near the discharge port when a print sheet is transferred to the paper discharge transportation route in accordance with the second embodiment of the present invention.

In this case, it is monitored when the discharge sensor 450 outputs an ON signal in step S207. FIG. 17B is a schematic diagram for showing the situation near the discharge port 140 when the print sheet 500 is transferred to the paper discharge transportation route DR. Thereafter, while being transported by the upper transportation roller unit 401, the leading edge of the print sheet 500 reaches the first paper discharge roller unit 411. However, since both the upper transportation roller unit 401 and the first paper discharge roller unit 411 are driven at the circulation transportation speed, it is possible to prevent a loud hitting sound from being caused when the print sheet 500 comes in contact with the first paper discharge roller unit 411 during transportation, and prevent the print sheet from being warped and deformed because of the differential speed between these roller units.

Figure 17C:
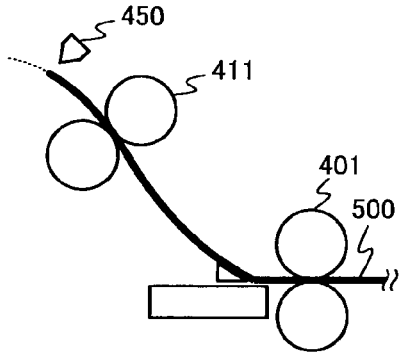
FIG. 17C is a schematic diagram for showing the situation near the discharge port when the leading end of the print sheet reaches the position of the discharge sensor in accordance with the second embodiment of the present invention.
Figure 17D:
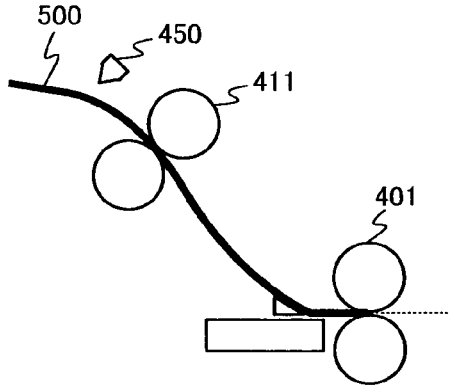
FIG. 17D is a schematic diagram for showing the situation near the discharge port when the trailing edge of the print sheet is passed through the upper transportation roller unit in accordance with the second embodiment of the present invention.

When the leading end of the print sheet 500 having been printed reaches the position of the discharge sensor 450 as illustrated in FIG. 17C, the discharge sensor 450 outputs an ON signal. When detecting the ON signal output from the discharge sensor 450 (i.e., the "Yes" branch from step S207), measurement of the time T3 is started in step S208. The time T3 elapses when the trailing edge of the print sheet 500 is passed through the upper transportation roller unit 401 as illustrated in FIG. 17D. In other words, when the time T3 has elapsed, the print sheet 500 gets rid of the constraint by the upper transportation roller unit 401. Then, the rotational speed of the first paper discharge roller unit 411 is switched to the optimal discharge speed in step S209. The rotational speed of the upper transportation roller unit 401 is not changed as it is at the circulation transportation speed. As a result, the upper transportation roller unit 401 and the first paper discharge roller unit 411 rotate at different rotational speeds. However, the print sheet 500 has already been passed through the upper transportation roller unit 401, the print sheet 500 is not warped or stretched. Meanwhile, the rotational speed of the first paper discharge roller unit 411 is not necessarily switched immediately after the time T3 elapsed, but can be switched to the optimal discharge speed at least after the time T3 elapsed.

Figure 17E:
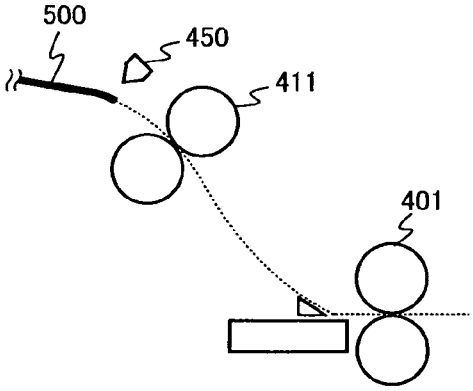
FIG. 17E is a schematic diagram for showing the situation near the discharge port when the trailing edge of the print sheet reaches the position of the discharge sensor in accordance with the second embodiment of the present invention.

After switching the rotational speed of the first paper discharge roller unit 411 to the optimal discharge speed, it is monitored when the discharge sensor 450 outputs an OFF signal in step S210. As illustrated in FIG. 17E, when the trailing edge of the print sheet 500 reaches the position of the discharge sensor 450, the discharge sensor 450 outputs an OFF signal. When detecting the OFF signal output from the discharge sensor 450 (i.e., the "Yes" branch from step S210), the print sheet 500 which has already passed through the first paper discharge roller unit 411 is discharged to the discharge port 140 by the inertia force of transportation at the optimal discharge speed. Because of this, the print sheet can be prevented from shooting out from the catch tray 150 or being stacked in a random fashion.

Since the discharge sensor 450 is located closer to the discharge port 140 than the first paper discharge roller unit 411, the print sheet 500 has already been passed through the first paper discharge roller unit 411 when the discharge sensor 450 outputs an OFF signal. Then, the rotational speed of the first paper discharge roller unit 411 is switched to the circulation transportation speed in step S211. The process as discussed above is repeated until the transportation is completed in step S212. When the transportation of all the print sheets 500 is completed (i.e., the "Yes" branch from step S212), the operation of each driving unit is stopped in step S213. Incidentally, the rotational speed of the first paper discharge roller unit 411 is not necessarily switched to the circulation transportation speed immediately after the discharge sensor 450 outputs an OFF signal, but can be switched to the circulation transportation speed at least after the discharge sensor 450 outputs an OFF signal.

Figure 16:
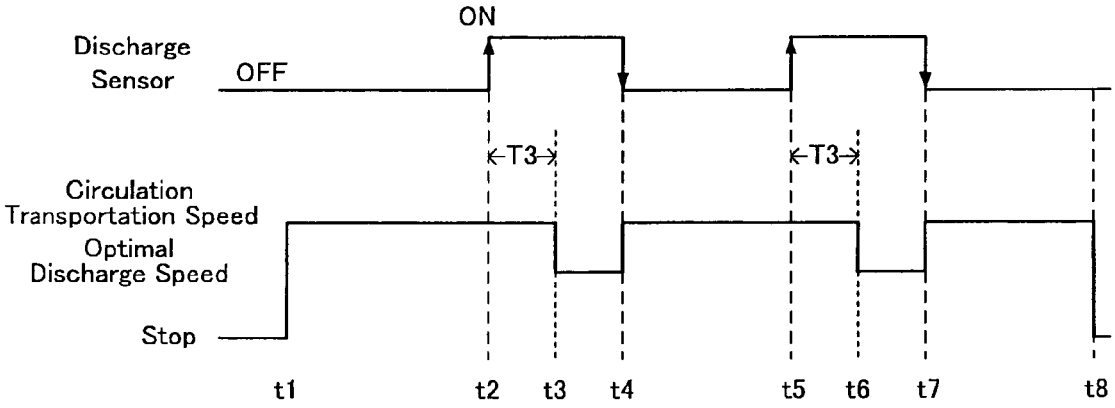
FIG. 16 is a graphic diagram for showing the waveform of the output signal of the discharge sensor and the waveform of the drive signal to be supplied to the first paper discharge roller unit in the case where the circulation transportation is performed in accordance with the second embodiment of the present invention.

FIG. 16 is a graphic diagram for showing the waveform of the output signal of the discharge sensor 450 and the waveform of the drive signal to be supplied to the first paper discharge roller unit 411 in the case where the circulation transportation is performed in accordance with the second embodiment. In this case as illustrated in FIG. 16, two print sheets are discharged. When the transportation is started at time point t1, the first paper discharge roller unit 411 is driven to transport the print sheet at the circulation transportation speed, and gets ready for receiving the first print sheet 500. When the discharge sensor 450 outputs an ON signal at the time point t2, measurement of the time T3 is started. When the time T3 has elapsed at time point t3, the first paper discharge roller unit 411 is driven to transport the print sheet 500 at the optimal discharge speed. When the discharge sensor 450 outputs an OFF signal at time point t4, the first paper discharge roller unit 411 is driven to transport the print sheet 500 at the circulation transportation speed, and gets ready for receiving the second print sheet 500. Just after the time point t4, the first print sheet 500 is discharged. When the discharge sensor 450 outputs an ON signal at the time point t5, measurement of the time T3 is started. When the time T3 has elapsed at time point t6, the first paper discharge roller unit 411 is driven to transport the print sheet 500 at the optimal discharge speed. When the discharge sensor 450 outputs an OFF signal at time point t7, the first paper discharge roller unit 411 is driven to transport the print sheet 500 at the circulation transportation speed. However, since all the print sheets 500 have been completely transported, the operation of driving the roller units is stopped at time point t8. The second print sheet 500 is discharged just after the time point t7.

Alternatively, in the case where the first paper discharge roller unit 411 is dispensed with but the second paper discharge roller unit 412 is used as a single discharge roller unit, the discharge control process can be performed in the same manner as in the first embodiment on the basis of DST1 and DST2.

The foregoing description of the embodiments has been presented for purposes of illustration and description. It is not intended to be exhaustive or to limit the invention to the precise form described, and obviously many modifications and variations are possible in light of the above teaching. The embodiment was chosen in order to explain most clearly the principles of the invention and its practical application thereby to enable others in the art to utilize most effectively the invention in various embodiments and with various modifications as are suited to the particular use contemplated.

What is claimed is:

1. A printing apparatus comprising:

a paper discharge roller unit configured to transport a print sheet to a discharge port;

a transportation roller unit configured to transport the print sheet to the paper discharge roller unit;

a transportation speed determination unit configured to determine a transportation speed at which the transportation roller unit is driven; and a paper discharge roller drive unit configured to drive the paper discharge roller unit at the transportation speed determined by the transportation speed determination unit during the time that the print sheet is being transported by the transportation roller unit, and then drive the paper discharge roller unit at a discharge speed which is determined independently from the transportation speed after the print sheet has left the transportation roller unit while the print sheet is being transported by the paper discharge roller unit, wherein a print sheet sensor is provided between the discharge roller unit and the discharge port, and wherein the paper discharge roller drive unit detects when the print sheet leaves the transportation roller unit on the basis of the detection result by the print sheet sensor, a distance between the transportation roller unit and a sensing position of the print sheet sensor, a length of the print sheet in the transportation direction, and the transportation speed determined by the transportation speed determination unit.

2. The printing apparatus as claimed in claim 1 wherein the paper discharge roller drive unit detects when the print sheet leaves the paper discharge roller unit on the basis of the detection result by the print sheet sensor.

3. A printing apparatus comprising:

a paper discharge roller unit configured to transport a print sheet to a discharge port;

a transportation roller unit configured to transport the print sheet to the paper discharge roller unit;

a transportation speed determination unit configured to determine a transportation speed at which the transportation roller unit is driven; and a paper discharge roller drive unit configured to drive the paper discharge roller unit at the transportation speed determined by the transportation speed determination unit during the time that the print sheet is being transported by the transportation roller unit, and then drive the paper discharge roller unit at a discharge speed which is determined independently from the transportation speed after the print sheet has left the transportation roller unit while the print sheet is being transported by the paper discharge roller unit, wherein a circulating transportation route is provided for causing the print sheet to circulate in a housing of the printing apparatus, and wherein the transportation speed determination unit determines the transportation speed to be equivalent to the discharge speed in the case where the print sheet is not circulated around the circulating transportation route.

4. The printing apparatus as claimed in claim 3 wherein the paper discharge roller unit comprises a first paper discharge roller unit located near the transportation roller unit and a second paper discharge roller unit located near the discharge port, wherein a print sheet sensor is provided between the first paper discharge roller unit and the second paper discharge roller unit, and wherein the paper discharge roller drive unit detects when the print sheet leaves the transportation roller unit on the basis of the detection result by the print sheet sensor, a distance between a sensing position of the print sheet sensor and the transportation roller unit, a length of the print sheet in the transportation direction, and the transportation speed determined by the transportation speed determination unit.

5. The printing apparatus as claimed in claim 4 wherein the paper discharge roller drive unit detects when the print sheet leaves the paper discharge roller unit on the basis of the detection result by the print sheet sensor, a distance between the sensing position of the print sheet sensor and the second paper discharge roller unit, and the discharge speed.

6. The printing apparatus as claimed in claim 4 wherein there is a space between the transportation roller unit and the first paper discharge roller unit for allowing the print sheet, which is being transported, to warp in the space.

7. A printing apparatus comprising:

a paper discharge roller unit configured to transport a print sheet to a discharge port;

a transportation roller unit configured to transport the print sheet to the paper discharge roller unit;

a transportation speed determination unit configured to determine a transportation speed at which the transportation roller unit is driven; and a paper discharge roller drive unit configured to drive the paper discharge roller unit at the transportation speed determined by the transportation speed determination unit during the time that the print sheet is being transported by the transportation roller unit, and then drive the paper discharge roller unit at a discharge speed which is determined independently from the transportation speed after the print sheet has left the transportation roller unit while the print sheet is being transported by the paper discharge roller unit, wherein a print transportation drive unit is provided for transporting the print sheet on which ink is sprayed, and wherein the transportation speed is determined to be higher than a speed of the print sheet which is transported by the print transportation drive unit during spraying ink on the print sheet.

8. The printing apparatus as claimed in claim 7 wherein the speed of transporting the print sheet during spraying ink on the print sheet is determined on the basis of a printer option which is selected by the user, and wherein the transportation speed is determined in accordance with a print schedule which is determined in advance of printing with respect to an order of print tasks and an interval between adjacent print tasks.

9. The printing apparatus as claimed in claim 7 wherein the paper discharge roller unit comprises a first paper discharge roller unit located near the transportation roller unit and a second paper discharge roller unit located near the discharge port, wherein a print sheet sensor is provided between the first paper discharge roller unit and the second paper discharge roller unit, and wherein the paper discharge roller drive unit detects when the print sheet leaves the transportation roller unit on the basis of the detection result by the print sheet sensor, a distance between a sensing position of the print sheet sensor and the transportation roller unit, a length of the print sheet in the transportation direction, and the transportation speed determined by the transportation speed determination unit.

10. The printing apparatus as claimed in claim 9 wherein the paper discharge roller drive unit detects when the print sheet leaves the paper discharge roller unit on the basis of the detection result by the print sheet sensor, a distance between the sensing position of the print sheet sensor and the second paper discharge roller unit, and the discharge speed.

11. The printing apparatus as claimed in claim 9 wherein there is a space between the transportation roller unit and the first paper discharge roller unit for allowing the print sheet, which is being transported, to warp in the space.

* * * * *